United States Patent [19]

Chappatte

[11] 4,104,866

[45] Aug. 8, 1978

[54] TIMEPIECE

[75] Inventor: Jean-Maurice Chappatte, Hauterive, Switzerland

[73] Assignee: Ebauches Electroniques S.A., Switzerland

[21] Appl. No.: 768,858

[22] Filed: Feb. 15, 1977

[30] Foreign Application Priority Data

Feb. 19, 1976 [CH] Switzerland ..... 2011/76

[51] Int. Cl.[2] ..... G04C 19/24; G04B 27/00

[52] U.S. Cl. ..... 58/85.5; 58/58

[58] Field of Search ..... 58/58, 63, 65, 67, 68, 58/72, 85.5, 90 B, 138, 139, 73

[56] References Cited

U.S. PATENT DOCUMENTS 3,151,441 10/1964 Tsuzuki ..... 58/85.5

3,319,415 5/1967 Von Aesch et al. ..... 58/85.5

*Primary Examiner*—Edith S. Jackmon

*Attorney, Agent, or Firm*—Silverman, Cass & Singer, Ltd.

[57] ABSTRACT

A timepiece with a control pinion loosely mounted on the stem of the timepiece. A spring urges the pinion to move axially on the stem. A coupling device is operable between the stem and the pinion to render the same angularly rigid with respect to each other. In one axial position of the stem, the pinion is moved to meshed engagement with an element of the timepiece which it is desired to be operated manually.

1 Claim, 3 Drawing Figures

TIMEPIECE

BACKGROUND OF THE INVENTION

The present invention relates to a timepiece comprising a rotatable control stem capable of occupying at least two axial positions.

SUMMARY OF THE INVENTION

The said timepiece is characterized by the fact that its control stem carries a pinion loosely mounted thereon, the pinion being submitted to the action of a resilient device which urges it to move in one direction axially on the said stem, a coupling device is arranged in such a way that the said stem and the said pinion are angularly rigid with respect to each other in at least one of the axial positions of the stem, said one position being such that the said pinion is in meshed engagement, at least indirectly, with an element of the timepiece which it is desired to be operated manually.

BRIEF DESCRIPTION OF THE DRAWING

The drawing shows, by way of example, one embodiment constructed in accordance with the invention.

DESCRIPTION OF THE PREFERRED EMBODIMENT

Figure 1:
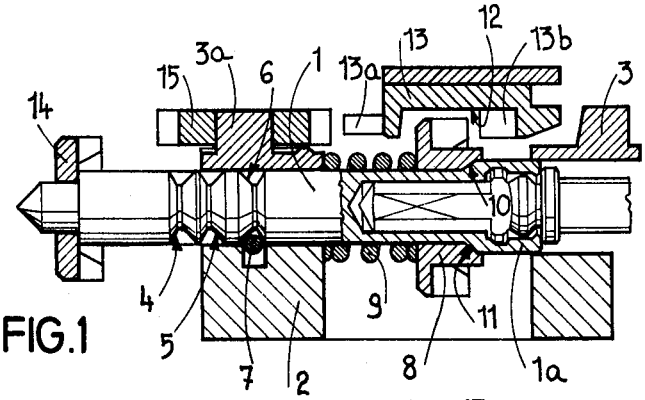
FIG. 1 is a partial sectional view of a watch, in which only the elements which are necessary to an understanding of the invention have been represented, this sectional view passing through the axis of the stem of the control mechanism of the watch, the same in the pushed position thereof.

The control mechanism of the watch partially represented comprises a control stem 1 slidably and rotatably mounted in a bracket 2 secured to the plate 3 of the movement, only a portion of which has been shown.

The stem 1 is provided with three annular grooves 4, 5 and 6, of generally V-shaped cross-sectional configuration. A wire spring 7 is engagable in said grooves to serve as and provide stability for three axial positions of the stem.

The stem 1 carries loosely mounted thereon a first level pinion 8 which is beared upon and therefore controlled by the action of a coil spring 9 engaged on the stem. One end of the spring 9 bears against one of the axial faces of the pinion 8 and on the other hand on the bracket 2. The coil spring thus urges the pinion 8 to be moved axially on the stem 1 in the direction toward the right side of the figures of the drawing. The pinion 8 is provided, on an axial face thereof opposite the one which the spring 9 bears, with a frusto-conical seat 10. The seat 10 cooperates, in some axial positions of the stem 1, with a frusto-conical bearing surface 11 provided on a shoulder 1*a* of the stem.

The level pinion 8 tangentially engages an annular recess 12 provided on the inner face of a date indicating crown 13. The crown 13 is provided with two inner toothings, one of which, designated by 13*a*, serving to its driving, once per 24 hours, by the gearing of the movement, and the other of which, designated by 13*b*, meshing, in some axial positions of the stem 1, with the pinion 8.

The stem 1 carries, force-fit on its inner end, a second level pinion 14 which meshes in one of the axial positions of the stem 1, with pinion 15 rotating on a journal 3*a* mounted on the base plate 3. The pinion 15 is associated with the setting gearing of the watch.

The control mechanism of the watch disclosed and represented operates as follows:

When the stem 1 occupies its pushed position (FIG. 1), the pinion 8 is pushed towards the left side of the figure, against the action of the spring 9, by the frusto-conical bearing surface 11 of the stem which cooperates therewith; the pinion 8 is thereupon released from the toothing 13*b* of the date indicator 13. Thus, the indicator 13 is not driven when the stem 1 is rotated. Likely, the pinion 14 is free from the pinion 15 so that the latter pinion is not driven, the stem 1 being thus inoperative.

Figure 2:
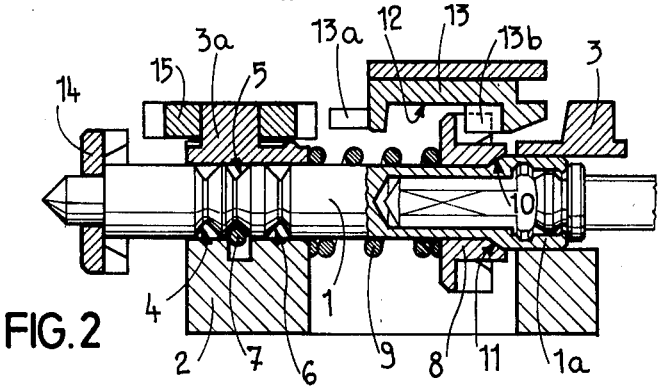
FIG. 2 is a similar sectional view, the mechanism being shown in the intermediary position of the stem.

When the stem 1 occupies its intermediate position (FIG. 2), the pinion 8 is in meshed engagement with the toothing 13*b* of the date indicator 13 and, at the same time, it is bears, by means of its frusto-conical seat 10, on the bearing surface 11 of the shoulder 1*a* of the stem, under the effect of the spring 9. The stem 1 is thus rendered rigid angularly with the pinion 8 by a friction coupling constituting a torque limitator. The rotation of the stem then permits driving of the date indicator 13, in view of the setting of said indicator; the friction provides however, that the mechanism is not dammaged if the correction is effected by the user at the very moment when the date indicator 13 is driven by the gearing of the movement acting on its toothing 13*a*. In this intermediate position of the stem 1, the pinion 14 is not meshed with the setting pinion 15, so that said latter pinion is not driven.

Figure 3:
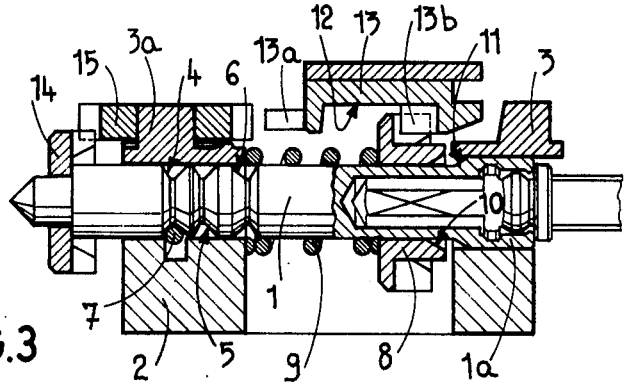
FIG. 3 is a similar view, the mechanism being shown in the pulled position of the stem.

When the stem 1 occupies its pulled position (FIG. 3), the pinion 8 is meshed with a toothing 13*b* of the date indicator 13 but its seat 10 is released from the bearing surface 11 of the shoulder 1*a* of the stem so that this pinion is not driven during the rotation of the stem. However, the pinion 14 is meshed with the setting pinion 15 so that the rotation of the stem permits the mechanism to effect setting of the watch.

What I claim is:

1. A timepiece having at least one element intended for manual operation, said timepiece comprising, a rotatable control stem movable between at least two axial positions, a pinion having two axial faces and being loosely mounted on said stem, a coil spring positioned upon the stem and engaged between one axial face of the pinion and the frame of the timepiece, said spring being operable upon the opinion to urge the same for axial movement in one direction on the stem, said pinion having a frusto-conical recess (on the axial face) thereof opposite said one axial face, said stem having a shoulder of frusto-conical configuration adapted for mating engagement with said recess on the pinion, whereby when the stem is moved to one axial position thereof the shoulder engages the frusto-conical recess of the pinion to render the stem and pinion angularly rigid with respect to each other and the pinion is moved into meshed engagement with said element, the engagement between the stem and pinion being a friction coupling operable as a torque limitator.

* * * * *